US011242863B2

(12) United States Patent
Xu et al.

(10) Patent No.: US 11,242,863 B2
(45) Date of Patent: Feb. 8, 2022

(54) FAN BLADE WITH IMPROVED STRUCTURE

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 17 days.

(21) Appl. No.: 16/221,588

(22) Filed: Dec. 17, 2018

(65) Prior Publication Data

US 2019/0203726 A1 Jul. 4, 2019

Related U.S. Application Data

(63) Continuation of application No. 15/063,519, filed on Mar. 8, 2016, now Pat. No. 10,480,525.

(51) Int. Cl.
*F04D 29/30* (2006.01)
*F04D 29/28* (2006.01)

(52) U.S. Cl.
CPC ..... *F04D 29/30* (2013.01); *F04D 29/282* (2013.01)

(58) Field of Classification Search
CPC .... F04D 29/281; F04D 29/624; F04D 29/388; F04D 29/34; F04D 25/08; F04D 19/002
See application file for complete search history.

(56) References Cited

U.S. PATENT DOCUMENTS 2,443,411 A * 6/1948 Wolfe ..... F04D 29/281 416/213 R
2,457,325 A * 12/1948 Sidell ..... 416/222
3,446,429 A * 5/1969 Tadayuki ..... F04D 29/646 416/220 A
4,060,338 A * 11/1977 Macauley ..... F04D 29/34 416/208
4,173,429 A * 11/1979 Hoffman ..... F01D 5/025 416/184
4,205,510 A * 6/1980 Raniero ..... A01D 34/82 56/12.9
4,662,830 A * 5/1987 Pottebaum ..... H05K 7/20172 361/695
4,715,784 A * 12/1987 Mosiewicz ..... F01D 5/3069 29/557

(Continued)

FOREIGN PATENT DOCUMENTS

CN 1643261 A 7/2005
CN 1877133 A 12/2006

(Continued)

*Primary Examiner* — Kenneth Bomberg
*Assistant Examiner* — Adam W Brown
(74) *Attorney, Agent, or Firm* — Bradley J. Thorson; DeWitt LLP

(57) ABSTRACT

A fan blade with improved structure includes a hub, a plurality of blades. The hub has a lateral side having two ends, one of which is formed a top side and the other end is extended to form an extended section, and a plurality of connecting slots located on the periphery of the extended section. Each blade has a first end correspondingly engaged in respective connecting slot and a second end. With these arrangements, the fan blade with improved structure can increase structural strength of thin fan blades and be easy to connect the hub to the blades.

9 Claims, 10 Drawing Sheets

(56) References Cited

U.S. PATENT DOCUMENTS 5,487,639 A * 1/1996 Asabuki ..... F04D 23/008 415/55.1
6,139,277 A * 10/2000 Lopatinsky ..... F01D 5/3015 416/220 A
6,568,907 B2 * 5/2003 Horng ..... F04D 29/282 416/185
6,619,923 B2 * 9/2003 Chien ..... F04D 29/2222 416/183
7,097,430 B2 * 8/2006 Harris ..... B29C 45/14065 264/45.3
7,381,027 B2 * 6/2008 Kaneko ..... F04D 29/30 415/206
7,399,161 B2 * 7/2008 Kao ..... F04D 29/30 416/187
7,775,719 B2 * 8/2010 Shishido ..... F16C 17/107 384/100
8,128,372 B2 * 3/2012 Best ..... F04D 29/34 416/207
8,333,438 B2 * 12/2012 Caule ..... B64C 25/36 188/264 AA
8,727,729 B2 * 5/2014 Noronha ..... B23P 15/006 416/186 R
8,807,939 B2 * 8/2014 Gardas ..... F04D 29/646 416/147
9,267,507 B2 * 2/2016 Wu ..... F04D 25/0613
9,341,192 B2 * 5/2016 Aiello ..... F04D 29/30
9,523,372 B2 * 12/2016 Stagg ..... B29C 45/14336
9,664,194 B2 * 5/2017 Oleson ..... F04D 25/088
2008/0130226 A1 * 6/2008 Yamashita ..... F04D 29/281 361/695
2009/0297344 A1 * 12/2009 Hill ..... F01D 5/048 415/208.1
2013/0195638 A1 8/2013 Huang et al.
2013/0243628 A1 * 9/2013 Zheng ..... F04D 17/04 417/423.7
2015/0013945 A1 * 1/2015 Choi ..... F24F 1/0007 165/121
2015/0233389 A1 * 8/2015 Moll ..... F04D 29/662 416/145

FOREIGN PATENT DOCUMENTS

CN 102954035 A 3/2013
CN 103104510 A 5/2013
CN 203175946 U 9/2013
CN 104196758 A 12/2014
JP 2011-47388 A 3/2011
TW M350746 2/2009
TW 201341167 A 10/2013
TW M502749 U 6/2015

* cited by examiner

FAN BLADE WITH IMPROVED STRUCTURE

The present application is a continuation of U.S. patent application Ser. No. 15/063,519, filed on Mar. 8, 2016.

FIELD OF THE INVENTION

The present invention relates to a fan blade with improved structure, and more specifically, to a fan blade with improved structure that can enhance structural strength of thin fan blades of a fan.

BACKGROUND OF THE INVENTION

A fan made of metal or plastic is widely used to remove heat produced by electronic elements. When the blades of the fan are made of plastic by injection technology processing, each blade must have a certain thickness, normally thicker than 0.3 mm, since the fan is unlikely to add the number of blades thereon, or it could break due to high instant stress of wind resistance when operating. Therefore, the inventor has strived to develop a fan blade with an improved structure to overcome the foregoing drawbacks in the prior art fan.

SUMMARY OF THE INVENTION

A primary object of the present invention is to provide a fan blade with improved structure that can increase structural strength of thin fan blades of a fan.

Another object of the present invention is to provide a fan blade with improved structure that can provide a better and easy way to connect the hub to the blades and that prevents a fan from imbalanced due to uneven distribution of weight which has been a problem with prior art fans.

To achieve the above and other objects, the fan blade with improved structure provided according to the present invention includes a central circular hub of a predetermined thickness, and a plurality of blades. The hub has a lateral side having two ends, one of which is formed as a top side and the other end is radially extended to form a flange having a plurality of regularly spaced connecting slots located on the periphery of the flange. Each blade has a first end correspondingly engaged in a respective one of the regularly spaced connecting slots and a second end.

With the first end of each blade correspondingly engaged in respective one of the connecting slots located on the periphery of the hub flange, and the blades are correspondingly engaged and fitted in the connecting slots of the hub by laser welding or mechanical processing, the composite fan assembly blade with improved structure offers increased structural strength of such assemblies without the risk of imbalance of the fan due to uneven distribution of weight which has been a problem in prior art fans.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
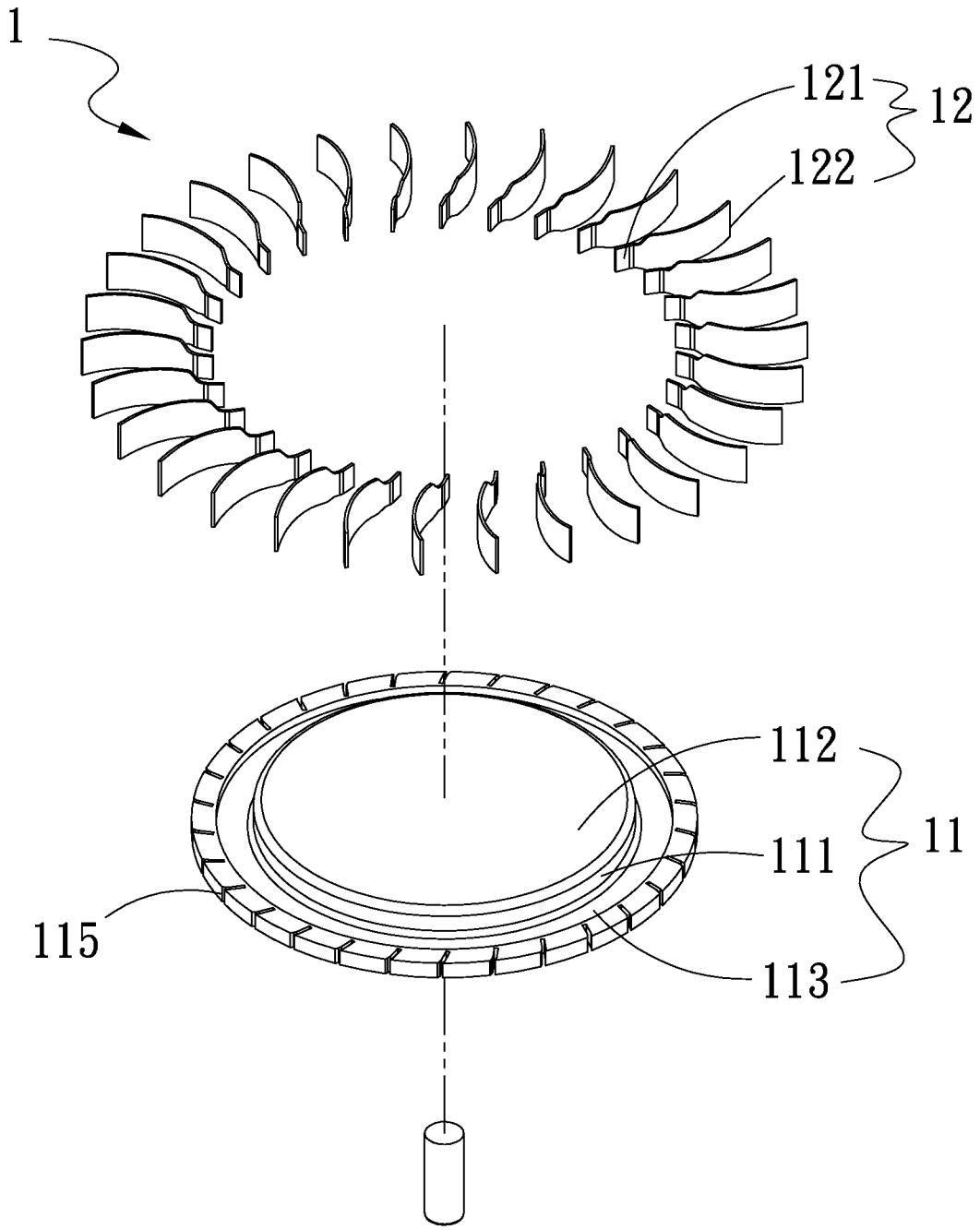
FIG. 1 is an exploded perspective view of a fan blade with improved structure of the present invention according to a first embodiment thereof.

The present invention will now be described with some preferred embodiments thereof and by referring to the accompanying drawings. For the purpose of easy to understand, elements that are the same in the preferred embodiments are denoted by the same reference numerals.

Figure 2:
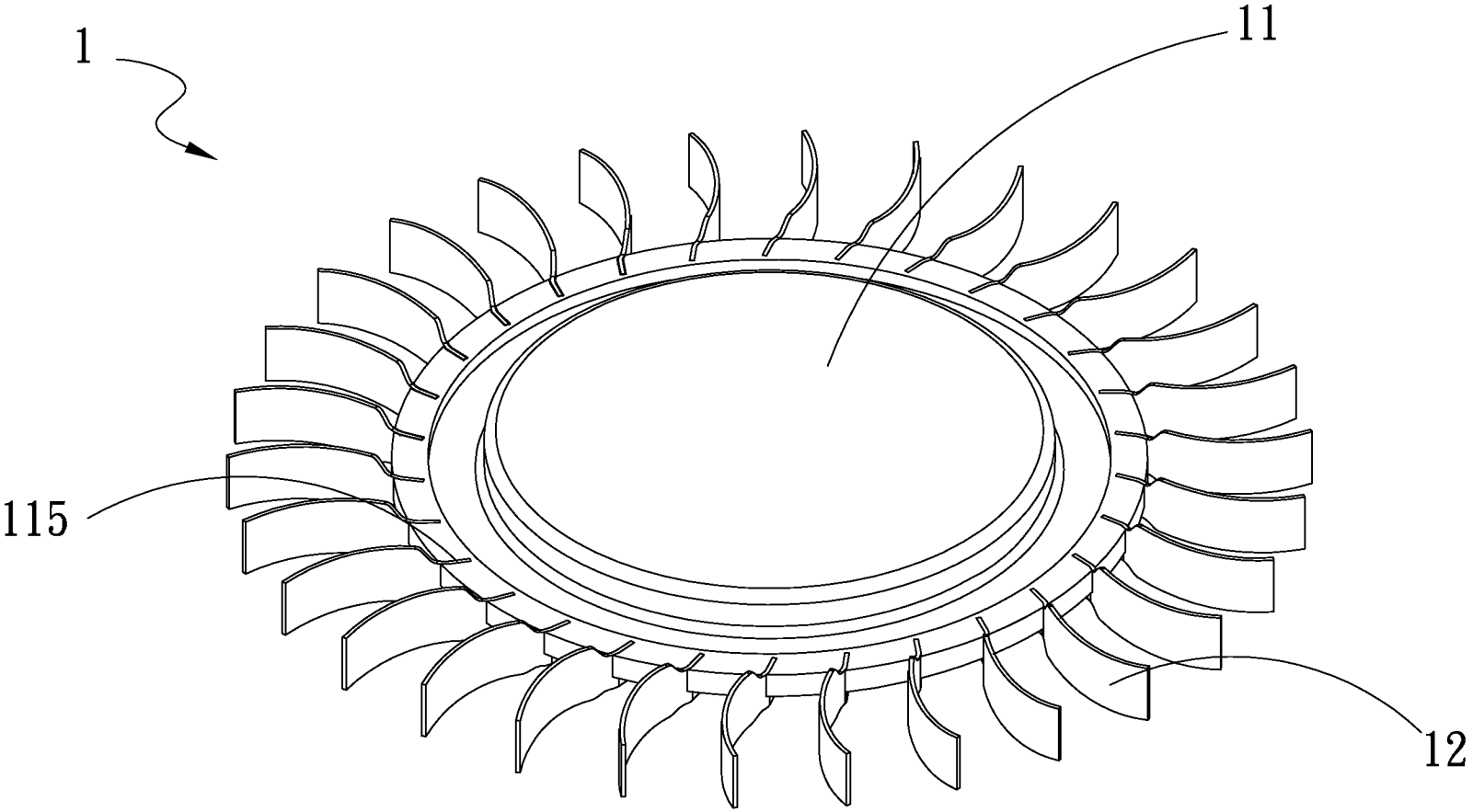
FIG. 2 is an assembled perspective view of FIG. 1.
Figure 3A:
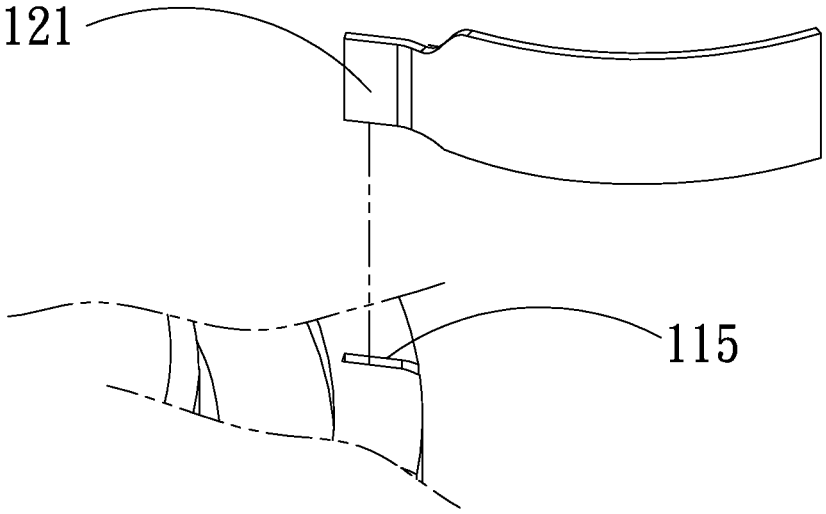
FIGS. 3A and 3B show partial views of the fan blade with improved structure before and after a first end of a blade is engaged in respective connecting slot included therein of the present invention according to the first embodiment thereof.
Figure 3B:
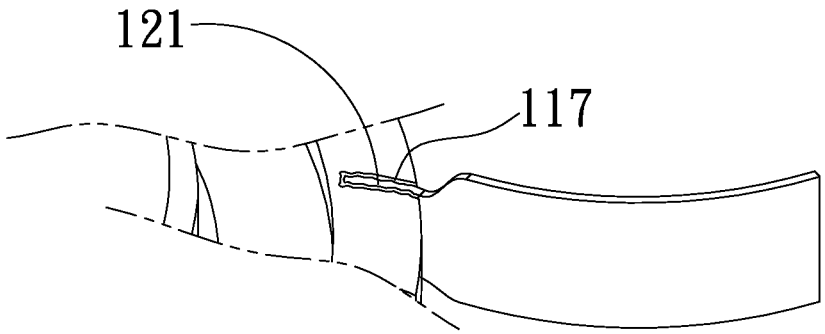
Figure 4:
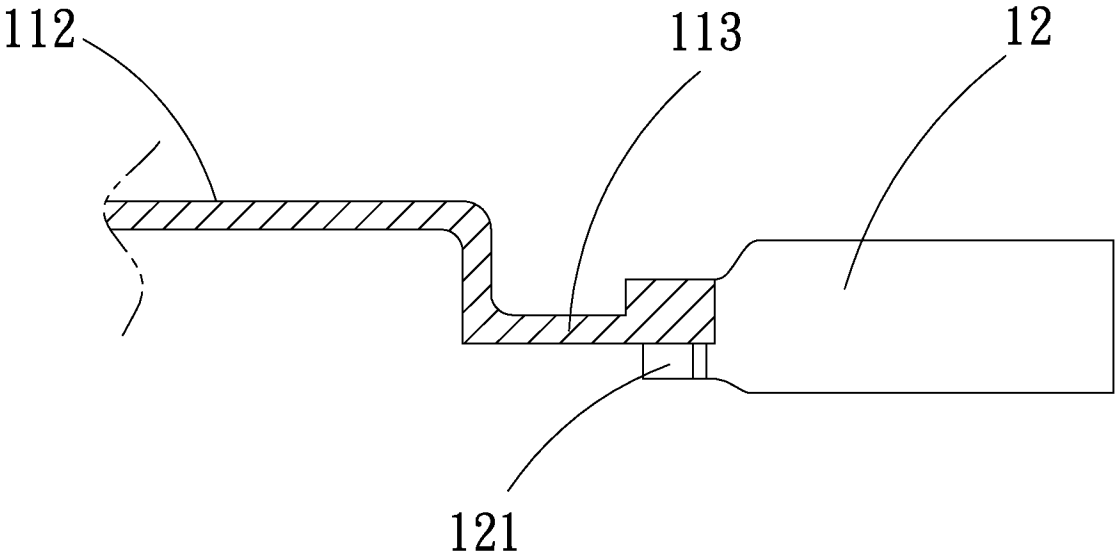
FIG. 4 is a fragmentary sectional view of the present invention according to the first embodiment thereof.

Please refer to FIGS. 1, 2, which are exploded and assembled perspective views, respectively, of a fan blade assembly with improved structure according to a first embodiment of the present invention, to FIGS. 3A and 3B that show the fan blade with improved structure before and after a first end of a blade member is engaged in respective connecting slot included therein according to a first embodiment of the present invention, and to FIG. 4 which is a fragmentary sectional view according to the first embodiment of the present invention. As shown, a fan blade assembly with improved structure 1 includes a hub 11, a plurality of blade members 12. The hub 11 has a peripheral side wall 111 extending between a top surface 112 and the other edge of the wall 111 is extended to form an extended flange section 113. A plurality of connecting slots 115 are located on the periphery of the flange 113. Also, the peripheral side wall 111, the top surface 112, and the extended section or flange 113 of the hub 11 are integrally molded.

In the illustrated first embodiment, the connecting slots 115 are equally spaced on the periphery of the flange 113. However, in practically implementation, the connecting slots 115 can be non-equally spaced on the periphery of the extended section 113 (not shown).

Each blade member 12 has a first end 121 and an opposite second end 122, wherein the first end 121 is a connecting end, whereas the second end 122 is a free end. The first end 121 is correspondingly engaged in respective connecting slot 115. In the illustrated first embodiment, each blade member 12 can be, but not limited to being a, curved-shaped. However, in a practical implementation, each blade 12 can be either curved-shaped or non-curved-shaped.

The first end 121 of each blade member 12 has a height less than or equal to that of the second end 122. In the illustrated first embodiment, the height of the first end 121 can be, but not limited to, smaller than that of the second end 122.

The blade members 12 in the illustrated first embodiment are made of metal by metal stamping or injection technology processing and preferably, each blade 12 has a thickness smaller than 0.15 mm. The hub 11 is also made of metal by die-casting or metal stamping. The blade members 12 are correspondingly engaged in the connecting slots 115 and forming a weld part 117 preferably by laser welding at the junction between the blade members 12 and the hub 11 (see FIG. 3B). In the illustrated first embodiment, since the blade members 12 and the hub 11 are made of metal, they are fused together to form the weld part 117 preferably by laser welding at the junction between the blade member 12 and the hub 11, such that the blade members 12 can be fixedly connected to the hub 11 without additional solder or filler to have enhanced structural strength of blade members 12 and to prevent a fan blade assembly from imbalanced due to uneven distribution of weight, a problem with the prior art fans.

With these arrangements, the first ends 121 of the blade members 12 are respectively correspondingly engaged in respective connecting slots 115 on the periphery of the extended flange section 113, then the first ends 121 are fixedly fitted in the connecting slots 115 by laser welding, such that the blade memebers 12 are fixedly connected to the hub 11, so as to largely enhance structural strength of blade members 12 and prevent the fan from imbalanced due to uneven distribution of weight caused by the use of solder or filler.

Figure 5:
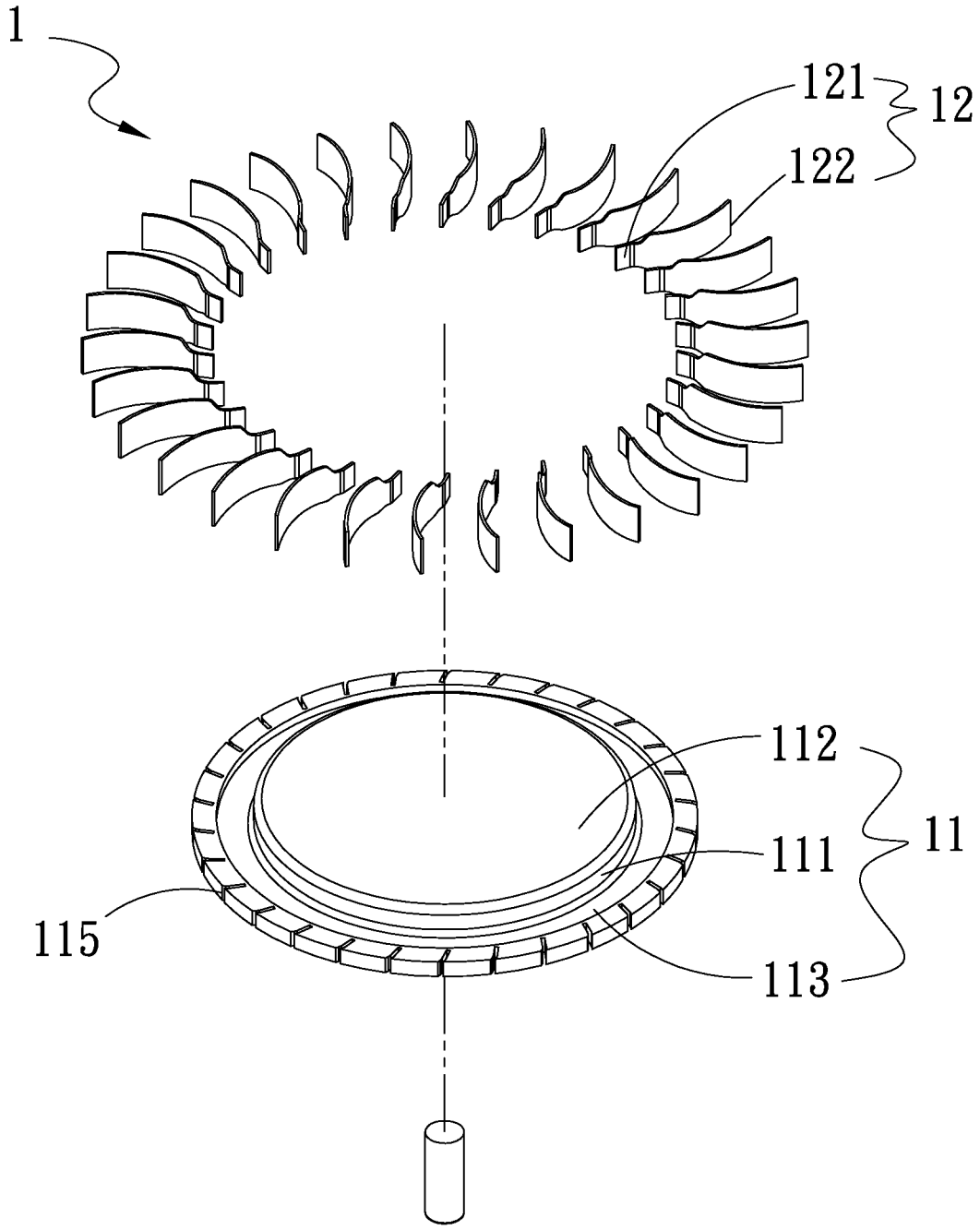
FIG. 5 is an exploded perspective view of the fan blade with improved structure of the present invention according to a second embodiment thereof.
Figure 6A:
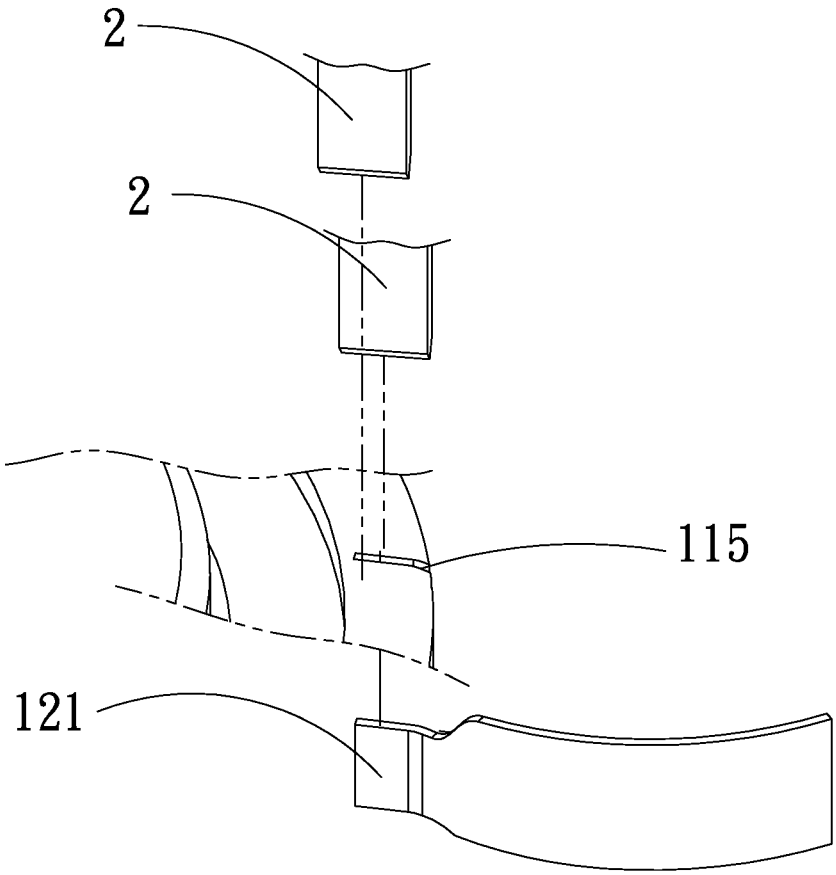
FIGS. 6A and 6B show partial views of the fan blade assembly with improved structure before and after a first end of a blade is engaged in a respective connecting slot included therein and two sides next to each connecting slot on a flange before and after downwardly are formed two recesses by two jigs used to fit the first end of each blade in a respective connecting slot included in the present invention according to the second embodiment thereof.
Figure 6B:
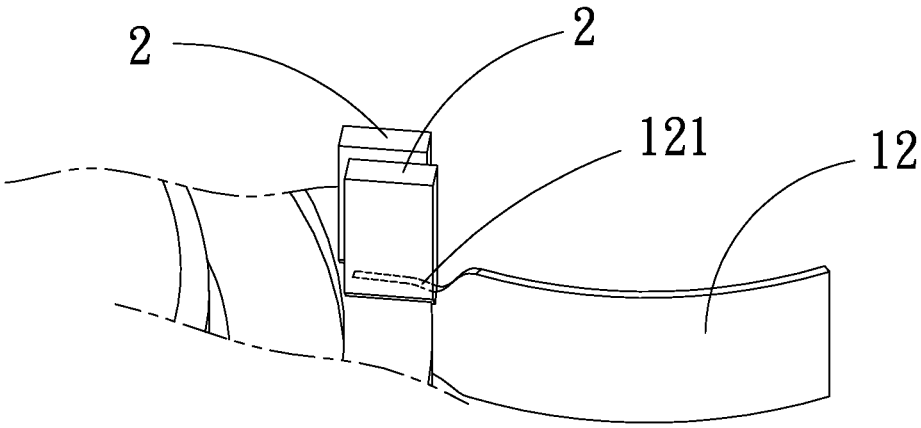
Figure 6C:
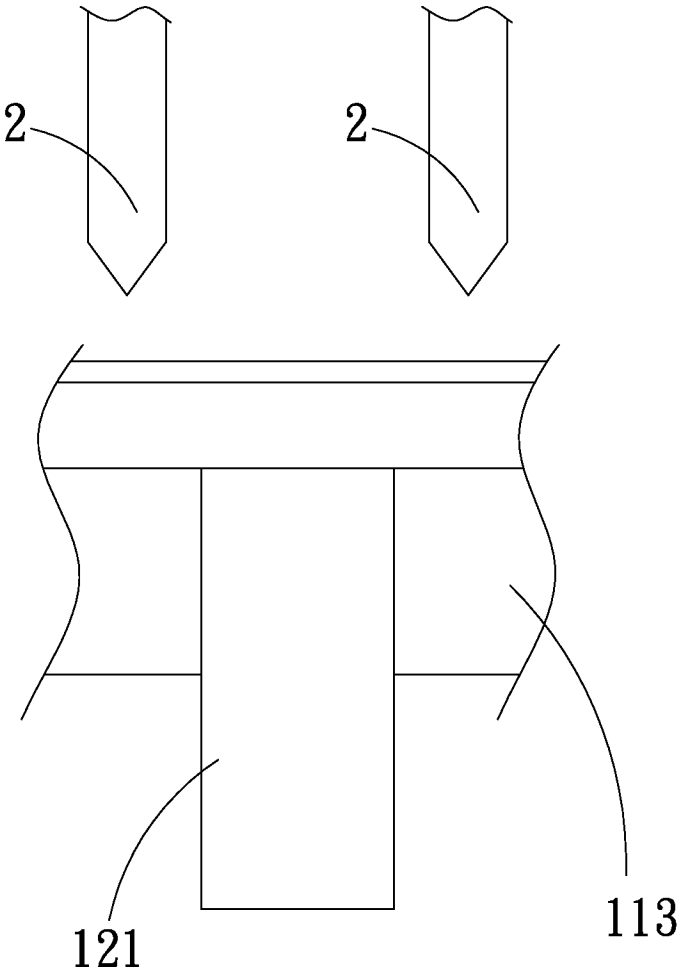
FIGS. 6C and 6D are enlarged views of FIGS. 6A and 6B.
Figure 6D:
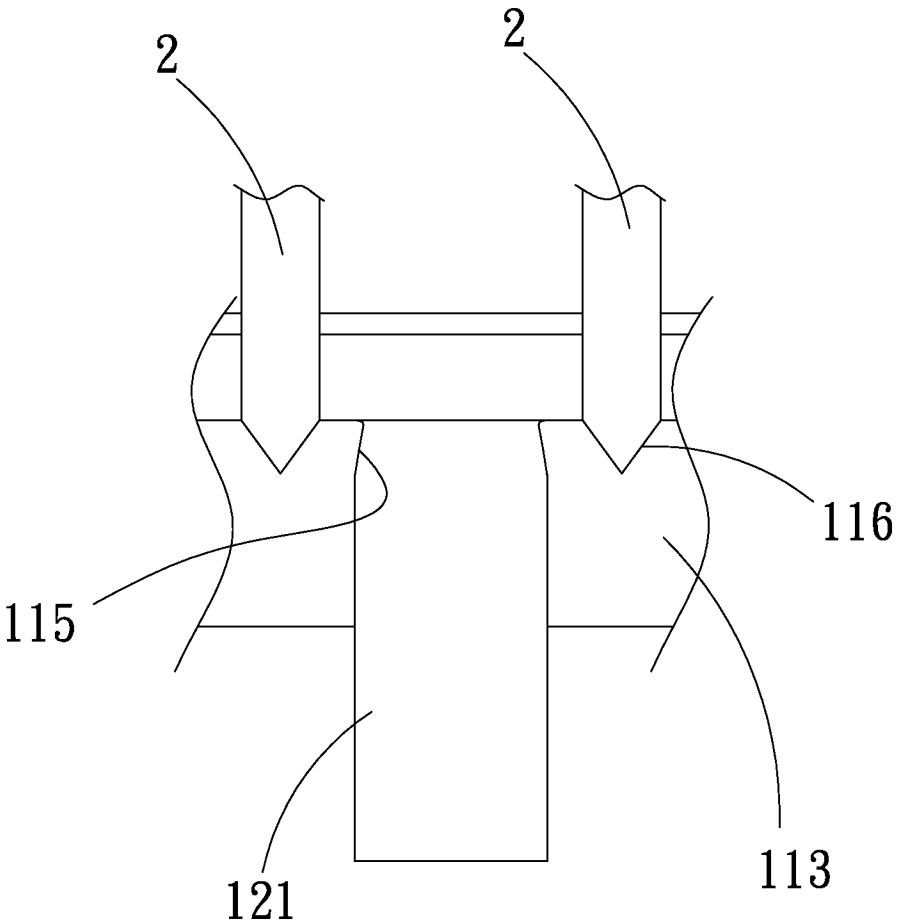

Please refer to FIG. 5, which is an exploded perspective view of the fan blade assembly with improved structure according to a second embodiment of the present invention, to FIGS. 6A and 6B, which show the fan blade with improved structure before and after a first end of a blade member is engaged in respective connecting slot included therein and two sides next to each connecting slot on the flange before and after two recesses are formed downwardly by two jigs to fit the first end of each blade member in a respective connecting slot according to the second embodiment of the present invention, and FIGS. 6C and D, which are enlarged views of FIGS. 6A and 6B. In another possible embodiment, after the first ends 121 of the blade members 12 are fitted in the connecting slots 115, respectively, two jigs 2 are downwardly or/and upwardly pressed onto the flange 113 at two lateral opposite sides of each connecting slot 115 to insert into the flange 113, such that two recesses 116 are formed and two opposite internal wall surfaces of the connecting slot 115 are internally squeezed to have the first end 121 of each blade member 12 fitted in respective connecting slot 115 on the extended flange section 113, so as to fixedly connect the blade members 12 to the hub 11.

Figure 7:
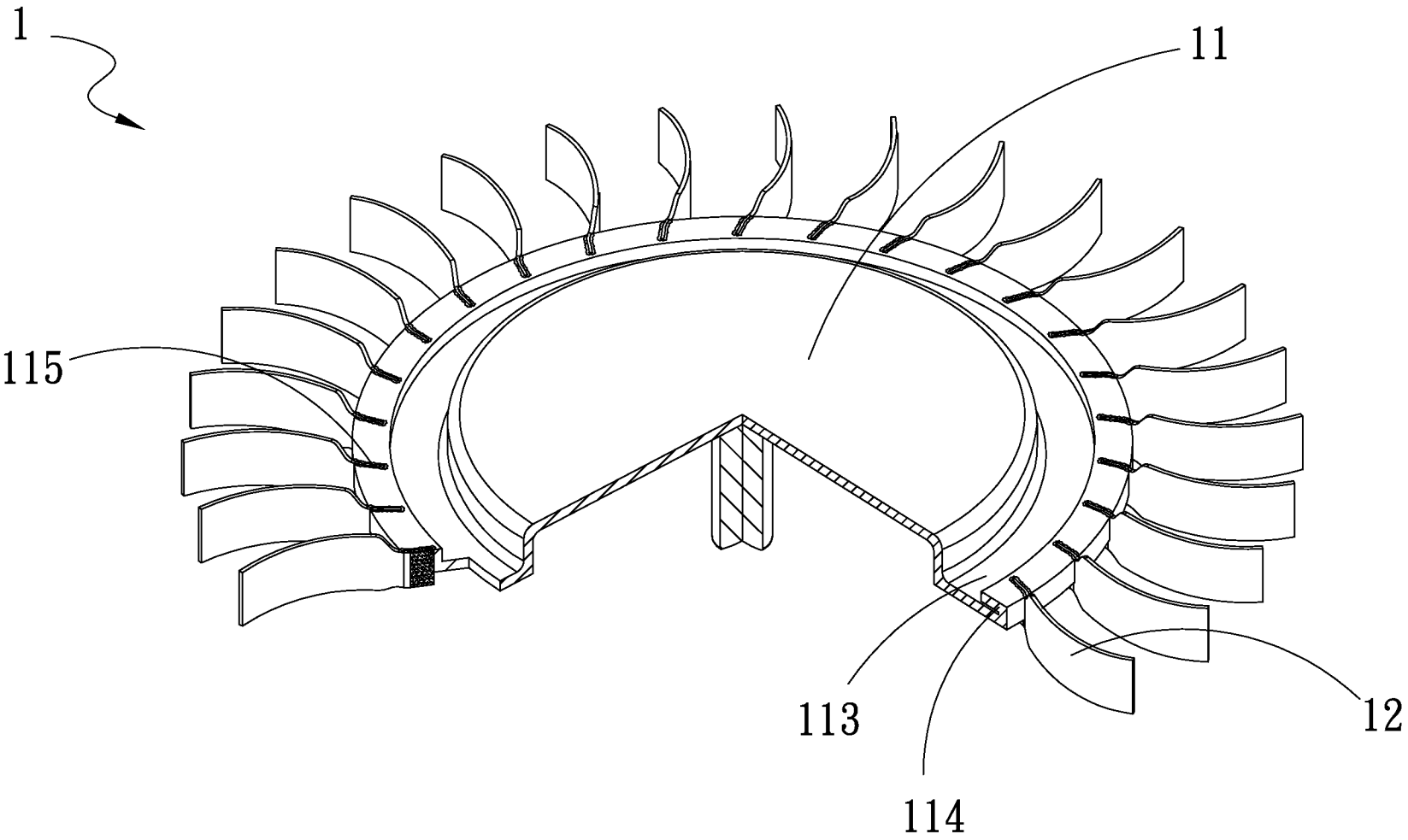
FIG. 7 shows a sectional perspective view of the fan blade with improved structure of the present invention according to a third embodiment thereof.
Figure 8:
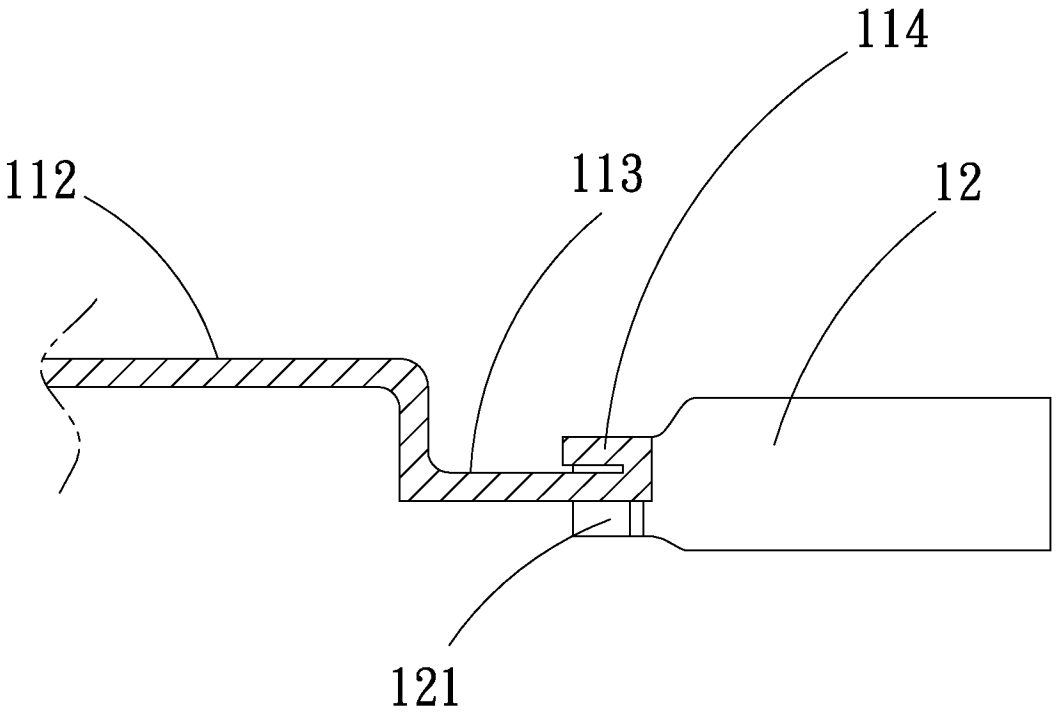
FIG. 8 is a fragmentary sectional view of the present invention according to the third embodiment thereof.

Next refer to FIG. 7, which shows a sectional perspective view of the fan blade assembly with improved structure according to a third embodiment of the present invention, and FIG. 8, which is a fragmentary sectional view according to the third embodiment of the present invention.

The third embodiment of the fan blade assembly with improved structure 1 is generally structurally similar to the first embodiment except that, in this third embodiment, the extended flange section 113 of the hub 11 is folded back upon itself to form a connecting portion 114 of double thickness. With the third embodiment, the first ends 121 of the blade members 12 are fitted in the connecting slots 115 by laser welding, providing the same effects as mentioned above.

In conclusion, compared to the prior art fan, the fan blade assembly of the present invention has many advantages as follows: (1) has enhanced structural strength of thin fan blade members; and (2) it provides a more effective way to connect the fan's hub to the blades which can eliminates fan imbalance due to uneven distribution of weight, a problem in prior art fans.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan blade assembly with improved structure, comprising:

a hub including a peripheral wall extending between two ends, one of the two ends presenting a top side, a circular flange section extending radially from the peripheral wall at the other of the two ends, a plurality of connecting slots being disposed in a periphery of the circular flange section, the connecting slots spaced apart from the peripheral wall; and a plurality of blade members, each of which having a first and an opposite second end;

and the first end correspondingly being engaged in a respective one of the plurality of connecting slots and forming a weld part by laser welding at the junction between the blade members and the hub;

wherein an upper edge of the first end of each of the blade members is flush with a top surface of the circular flange section and a lower edge of the first end of each of the blade members protrudes out from a bottom surface of the circular flange section.

2. The fan blade assembly with improved structure as claimed in claim 1, wherein the periphery of the circular flange section is upwardly extended toward the top side to form a connecting portion, in which the connecting slots are disposed.

3. The fan blade assembly with improved structure as claimed in claim 2, wherein the connecting slots are equally or non-equally spaced on the connecting portion.

4. The fan blade assembly with improved structure as claimed in claim 1, wherein each blade member is curved-shaped or non- curved-shaped.

5. The fan blade assembly with improved structure as claimed in claim 1, wherein the first end of each blade member has a height dimension smaller than or equal to the second end of each blade member.

6. The fan blade assembly with improved structure as claimed in claim 1, wherein both the hub and the blade members are made of the same or different materials.

7. The fan blade assembly with improved structure as claimed in claim 1, wherein each blade member has a thickness smaller than 0.15 mm.

8. The fan blade assembly with improved structure as claimed in claim 1, wherein the peripheral wall, the top side, and the circular flange section of the hub are integrally molded.

9. The fan blade assembly with improved structure as claimed in claim 1, wherein two lateral opposite sides next of each connecting slot on the circular flange section are downwardly formed pair of recesses formed by two jigs being inserted, such that two opposite internal wall surfaces of each connecting slot are internally squeezed to fit the first end of each blade member in a respective connecting slot.

* * * * *